United States Patent [19]

Mayer et al.

[11] 4,103,377

[45] Aug. 1, 1978

[54] KNAPSACK-PARKA SLEEPING BAG

[75] Inventors: James W. Mayer; Albert G. Smart, both of Santa Fe, N. Mex.

[73] Assignee: Mel A. Pfreizer, Santa Fe, N. Mex.

[21] Appl. No.: 763,035

[22] Filed: Jan. 27, 1977

[51] Int. Cl.[2] ..... A47G 9/08

[52] U.S. Cl. ..... 5/343; 2/69.5; 224/9

[58] Field of Search ..... 2/93, 94, 86, 69, 69.5, 2/125, 72; 224/8 R, 9; 5/343

[56] References Cited

U.S. PATENT DOCUMENTS

| | | | |
|---|---|---|---|
| 650,074 | 5/1900 | Conley | 2/89 |
| 1,773,456 | 9/1930 | Good | 2/93 X |
| 1,829,871 | 11/1931 | Morck | 2/93 |
| 2,379,511 | 7/1945 | Federman | 2/125 X |
| 2,428,795 | 10/1947 | Frazee | 2/69.5 X |
| 2,911,649 | 11/1959 | Ruelle et al. | 2/69.5 |

FOREIGN PATENT DOCUMENTS

| | | | |
|---|---|---|---|
| 1,252,604 | 10/1967 | Fed. Rep. of Germany | 2/69.5 |

*Primary Examiner*—Werner H. Schroeder
*Assistant Examiner*—Moshe I. Cohen

[57] ABSTRACT

This invention reduces the weight and bulk of the hiker's backpack by eliminating the sleeping bag as a separate item. This is accomplished by providing insulating walls in the knapsack and providing the knapsack with a foldable insulating extension so that the insulated elongated knapsack can be attached to the bottom end of a parka to provide a continuous enveloping sleeping bag.

3 Claims, 4 Drawing Figures

KNAPSACK-PARKA SLEEPING BAG

SUMMARY OF THE INVENTION

This invention concerns itself with the problem of achieving a minimal backpack load for the hiker whle maintaining the inventory of apparel and equipment essential to survival and comfort. More specifically, the invention is directed to eliminating the separate sleeping bag which is useful only when the hiker is at rest, but which is dead weight and bulk when the hiker is on foot. The hiker's knapsack and parka are modified in a novel manner to combine in a continuous insulated sleeping bag.

Various attempts have been made in the prior art to modify a garment such as a coat in U.S. Pat. Nos. 2,644,948 and 650,074, to provide two or more functions. However, in the prior art it appears that the objective of reducing the items to be carried was achieved by radical modifications in the coat.

An objective of the present invention is to provide a sleeping bag by utilizing a parka in combination with a modified knapsack without radical change in the configuration of the coat. This same objective applies to the knapsack, which, though adapted to form an essential part of a sleeping bag, when used as a knapsack, does not depart radically from the configuration of the state of the art knapsack. The accomplishment of these objectives is important because parkas and knapsacks have obtained their present efficient configurations through long experimental evolution and it is essential that the advantages inherant in the present art of parka and knapsack be preserved.

In brief, the objectives of this invention are obtained by insulating the walls of the knapsack and providing a collapsible insulating extension of the lateral walls of the knapsack, so that, for example in extended condition, a continuous insulatng envelope is provided having a length approximately equal to the length of the user's body from the feet to the waist in the case where the parka is slightly longer than waist length. The sleeping bag is completed by detachably connecting the lower end portion of the parka to the open end of the extended knapsack in a continuous draft-proof joint. The parka is provided with a full length closing mechanism in front whereby the combination of closed parka and extended knapsack provides a full length, completely closed, insulated and comfortable sleeping bag. In order that the hiker, when in the bag, can have his arms and hands inside the bag or extend them through the parka sleeves, the inner end portions of the sleeves are flared to join with adequately enlarged openings in the body of the parka so that the arms and hands can be inserted into or withdrawn from the parka sleeves while the parka is fully closed.

The manner of achieving the above and other objects and advantages of the present invention will become apparent from the following description taken with the drawing.

In the drawing

Figure 1:
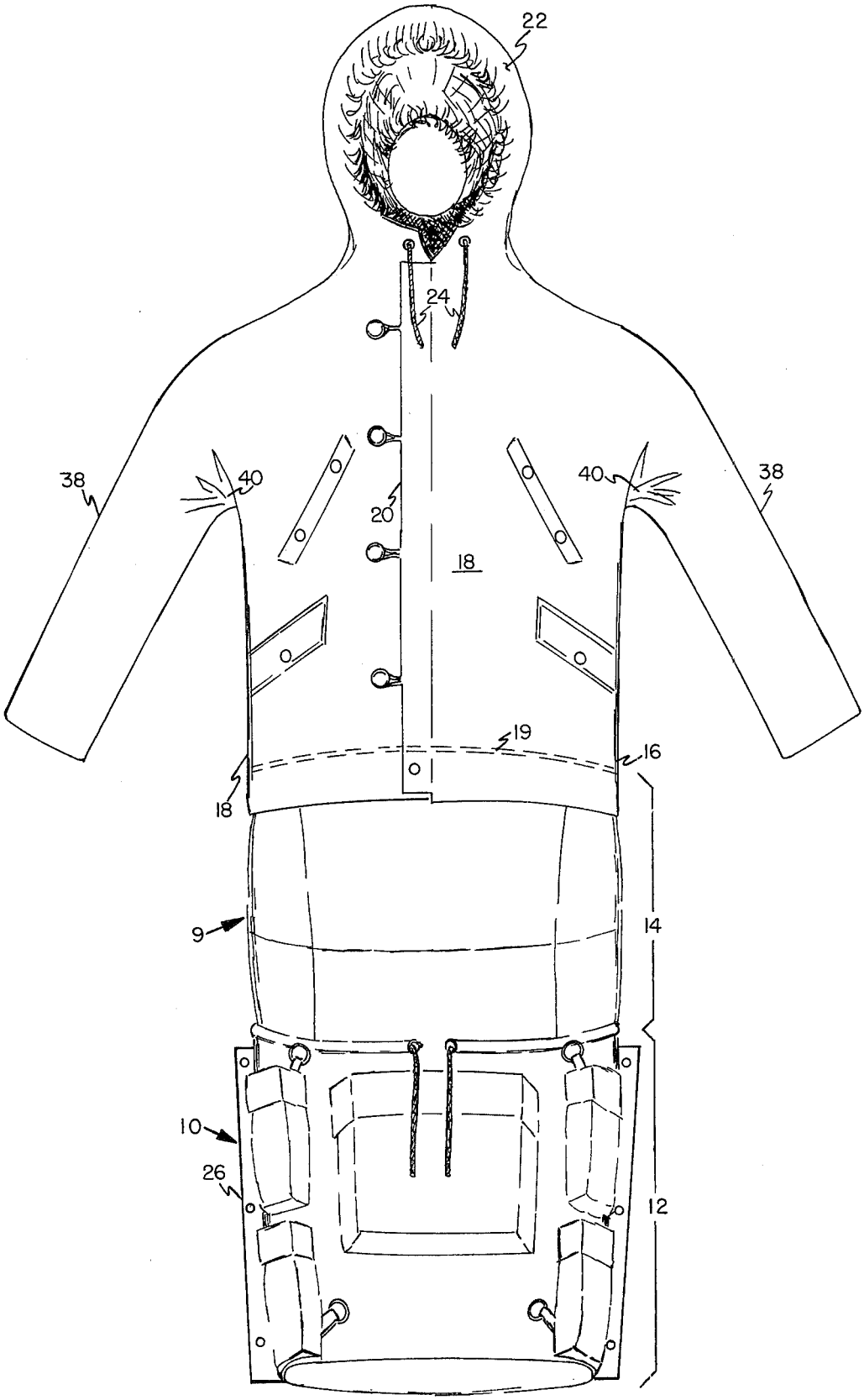
FIG. 1 is a perspective view of the sleeping bag of the present invention.

Referring to FIG. 1, a knapsack referred to generally by numeral 10 comprises a fixed length portion 12 integral with a collapsible portion 14 having a cross section generally similar to the cross section of portion 12. The open end of the portion 14 is attached to the inside surface of a lower end portion 16 of parka 18. The knapsack open end is adapted to be joined to the inner liner of the parka several inches above the lower end of the parka as at location 19 so that the portion of the parka depending from location 19 effectively insulates the junction zone. The parka 18 is provided with the usual vertical front closing mechanism covered with flap 20 except that the closing mechanism and flap extend to the lower end of the parka to effectively insulate the connection between knapsack and parka. The parka is equipped with an ample hood 22 provided with drawstring 24 to the end that the hood opening can be closed about the user's face to the extent desired.

It is further noted with reference to FIG. 1 that the knapsack fixed portion 12 and the parka 18 are provided with the usual external pouches, pockets and drawstrings, none of which are obviated by the present invention. Flaps or flanges 26 are affixed to the lateral edges of the knapsack fixed portion 12 to cooperate with knapsack attaching means on a backpack frame shown in FIG. 4.

Figure 2:
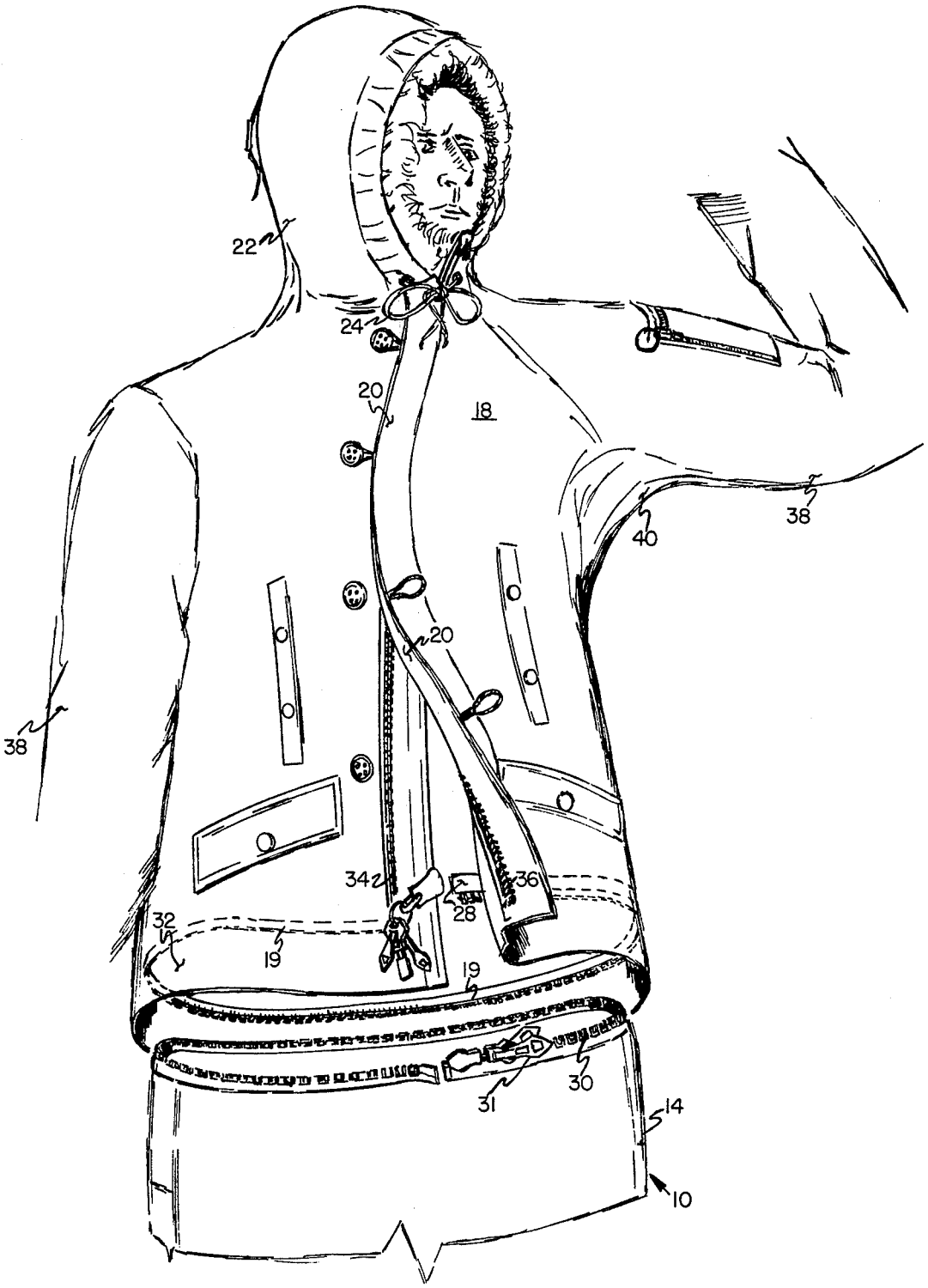
FIG. 2 is a vertical front exploded view of the parka in open condition with a cross sectional fragment of the knapsack extended portion.

Referring now to FIG. 2, additional details of the novel sleeping bag are explained. The horizontal fastening mechanism shown at location 19 in FIG. 1 comprises a complimentary pair of slide fastener parts 28–30 and slider 31 with inside and outside handles. One slide fastener part 28 is affixed to the inner liner of parka 18 spaced from the bottom end of the parka by a distance, such as three inches or more. Complimentary slide fastener part 30 is affixed to the upper end of the knapsack collapsible portion 14. When the slide fastener parts are joined together, the upper portion of the knapsack collapsible portion 14 and the lower end portion 32 of the parka are overlapped to thermally insulate the zone of juncture. The parka front closure mechanism is a pair of complimentary slide fastener parts 34–36 and a slide fastener with inside and outside handles. The use and location of parts 34–36 are generally old except that these slide fastener parts extend to below the horizontal fastener part 28 to the end that when the slide fasteners are closed, no gaps or leaks penetrate the thermal protection of the sleeping bag.

In the utilization of the present invention, provision is made for the establishment of the sleeping bag 9 without the wearer of the parka having to remove the parka. The user draws the extended knapsack 10 onto his body into the joining position with the parka. In order to close the horizontal slide fasteners between parka and knapsack with the parka closed, the wearer is best served with his arms and hands inside the parka. To this end, the inner end portions 40 of parka sleeves 38 are flared into an enlarged oval or elliptical juncture with the major axis vertical with the parka body so that the user can insert or withdraw his arms into or from, the parka sleeves while completely enclosed in the parka or the sleeping bag. Both sets of slide fasteners have sliders with both inside and outside handles. Other advantages derive from the configuration of the parka sleeves of the present invention among which is the ability of the user, even tho recumbent inside the bag, to protect himself quickly and unobtrusively, in the event of molestation, by inserting his arm and hand into a sleeve to utilize a weapon, previously deposited therein.

Figure 3:
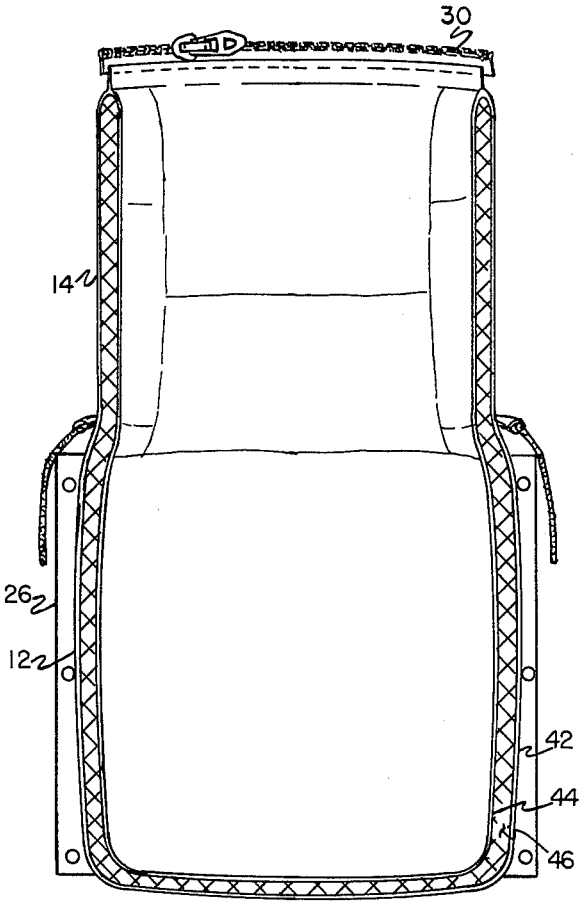
FIG. 3 is a vertical view partly in section of the knapsack fully extended for use as the bottom half of a sleeping bag.

The construction of the extendible knapsack is shown in cross section in FIG. 3. The knapsack walls are laminated, with an outer and inner lamina 42, 44, respectively, of flexible sheet material and a middle lamina 46 of insulation. Various insulation materials are well known in the art but for the purposes of this invention, synthetic slab type insulation is preferred to avoid the necessity for compartmentalizing, i.e., thin seamed areas. The insulation layer 46 in the fixed knapsack portion 12 may, depending on intended usage, be thicker than the insulation in the collapsible portion 14. This construction would provide increased thermal protection for the lower extremities without creating problems due to bulk as would be the case in the collapsible portion 14. Although the term "fixed" is used herein to describe the knapsack proper, the term is used to indicate that this portion of an extendible knapsack is not folded or rolled in the manner of the collapsible portion 14.

Figure 4:
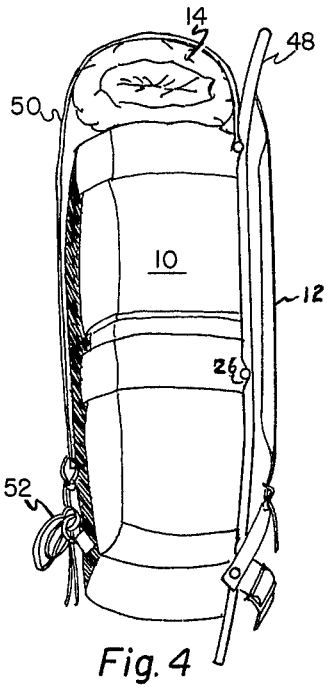
FIG. 4 is a side vertical cross section of the knapsack in carrying condition.

The knapsack in carrying condition is illustrated partly in vertical side section in FIG. 4. Collapsible portion 14 is folded into a compact roll over the top end of knapsack fixed portion 12 after the latter is packed. The side flanges 26 are are shown attached to the backpack frame 48. In this condition of the knapsack, the usual protective cover flap 50 is secured in place over the top and rear side of the knapsack by tie cords 52.

What is claimed is:

1. A sleeping bag comprising in combination, a parka and a knapsack, said knapsack having a substantially rectangular hollow bag-shape lower closed end portion formed by shape defining insulating lateral walls and an insulating bottom wall, a pair of flanges attached to and extending colinearly outwardly from and in the plane of one of the lateral walls whereby the knapsack lower end portion is adapted to be secured to and carried on a backpack frame; a substantially limp elongated insulating tube portion connected at one end to the open end of the knapsack closed end portion whereby it forms when in extended condition, a tubular insulating extension thereof, the combined length of the knapsack closed end portion and the tubular extension, (when extended,) being adequate to house the body of the user from feet to (hips) — a lower portion of said parka — substantially, and the combined lengths of the knapsack closed end portion and the tubular extension when compacted being that of the knapsack closed end portion substantially; (a parka,) said parka comprising inner and outer walls and an insulating layer therebetween, detachable fastening means comprising two elongated coextensive cooperative elements, means affixing one of said cooperative elements to the inner wall of the parka parallel to the bottom edge thereof and spaced from said bottom edge by the width of a depending parka flap portion, and the other cooperative element of the detachable fastening means being attached to the free end of the knapsack limp tube portion around all the peripheral extent thereof, the inside transverse peripheral extent of the parka when closed at the location of the detachable fastening means being equal to the peripheral extent of the free end of the knapsack limp tube portion, whereby said fastening means is adapted to detachably fasten the open end of the knapsack insulating tube portion throughout its peripheral extent to the inside wall of said parka to form a draft proof junction, the flap portion of said parka covering the fastening means to thermally insulate the fastening means, and the junction between parka and knapsack elongated insulating tube portion.

2. The sleeping bag of claim 1, in which the fastening means for detachably fastening the knapsack elongated insulating tube portion open end to the inside wall of the parka is a pair of complementary slide fastener parts and a slider having inside and outside pull handles whereby the fastening means can be manipulated from inside or outside the sleeping bag.

3. The invention of claim 1 in which said parka is provided with two sleeves, said sleeves being connected to the parka in an enlarged juncture whereby the wearer is enabled to insert into or withdraw his arms from said sleeves under any condition including that in which the parka is fully closed and fastened.

* * * * *